US008065845B1

(12) United States Patent
Sorkin

(10) Patent No.: US 8,065,845 B1
(45) **Date of Patent: *Nov. 29, 2011**

(54) ANCHORAGE WITH TENDON SHEATHING LOCK AND SEAL

(76) Inventor: Felix L. Sorkin, Stafford, TX (US)

( * ) Notice: Subject to any disclaimer, the term of this patent is extended or adjusted under 35 U.S.C. 154(b) by 483 days.

This patent is subject to a terminal disclaimer.

(21) Appl. No.: 12/175,905

(22) Filed: Jul. 18, 2008

(51) Int. Cl.
*E04C 5/08* (2006.01)
*E04C 5/12* (2006.01)
*A44B 1/04* (2006.01)

(52) U.S. Cl. ..... 52/223.13; 52/223.6; 24/122.6; 24/115 M

(58) Field of Classification Search ..... 52/223.1, 52/223.4, 223.5, 223.6, 223.7, 223.13, 223.14; 24/122.6, 115 M
See application file for complete search history.

(56) References Cited

U.S. PATENT DOCUMENTS

| | | | | |
|---|---|---|---|---|
| 3,844,697 | A * | 10/1974 | Edwards | 425/111 |
| 4,719,658 | A * | 1/1988 | Kriofske | 52/223.13 |
| 4,773,198 | A * | 9/1988 | Reinhardt | 52/223.13 |
| 5,630,301 | A * | 5/1997 | Sieg | 52/223.13 |
| 5,755,065 | A * | 5/1998 | Sorkin | 52/223.13 |
| 5,839,235 | A * | 11/1998 | Sorkin | 52/223.13 |
| 5,897,102 | A * | 4/1999 | Sorkin | 254/29 A |
| 6,098,356 | A * | 8/2000 | Sorkin | 52/223.13 |
| 6,354,596 | B1 * | 3/2002 | Rodriguez | 277/317 |
| 6,381,912 | B1 * | 5/2002 | Sorkin | 52/223.13 |
| 6,513,287 | B1 * | 2/2003 | Sorkin | 52/223.13 |
| 6,631,596 | B1 * | 10/2003 | Sorkin | 52/223.13 |
| 6,684,585 | B2 * | 2/2004 | Campbell | 52/223.13 |
| 6,761,002 | B1 * | 7/2004 | Sorkin | 52/223.13 |
| 6,817,148 | B1 * | 11/2004 | Sorkin | 52/223.13 |
| 7,174,685 | B2 * | 2/2007 | Hayes | 52/223.6 |
| 7,275,347 | B2 * | 10/2007 | Hayes | 52/223.13 |
| 7,424,792 | B1 * | 9/2008 | Sorkin | 52/223.13 |
| 7,726,082 | B2 * | 6/2010 | Hayes et al. | 52/223.13 |
| 7,793,473 | B2 * | 9/2010 | Sorkin | 52/223.13 |
| 7,797,894 | B1 * | 9/2010 | Sorkin | 52/223.13 |
| 7,797,895 | B1 * | 9/2010 | Sorkin | 52/223.13 |
| 7,823,345 | B1 * | 11/2010 | Sorkin | 52/223.13 |
| 2002/0007604 | A1 * | 1/2002 | Wallstein | 52/223.13 |
| 2004/0148880 | A1 * | 8/2004 | Hayes | 52/223.1 |
| 2004/0148882 | A1 * | 8/2004 | Hayes | 52/223.14 |
| 2005/0284050 | A1 * | 12/2005 | Hayes | 52/223.13 |
| 2008/0302035 | A1 * | 12/2008 | Shin | 52/223.13 |

* cited by examiner

*Primary Examiner* — Basil Katcheves
*Assistant Examiner* — Ryan Kwiecinski
(74) *Attorney, Agent, or Firm* — Egbert Law Offices PLLC

(57) ABSTRACT

A post-tension apparatus has an anchor member having a cavity formed in an interior thereof, a tendon extending through the cavity of the anchor member the has an unsheathed portion and a sheathed portion, an encapsulation affixed to the anchor member and extending thereover that has a trumpet formed at one end of the anchor member, a sheathing lock positioned in the cavity and engaged with the sheathed portion of the tendon, a seal affixed within the trumpet so as to reside in liquid-tight sealing relation with the sheathed portion of the tendon, and wedges recessed in the cavity of the anchor member. The pair of wedges is engaged with the unsheathed portion of the tendon. The sheathing lock is positioned adjacent an end of the pair of wedges.

14 Claims, 3 Drawing Sheets

ANCHORAGE WITH TENDON SHEATHING LOCK AND SEAL

CROSS-REFERENCE TO RELATED U.S. APPLICATIONS

Not applicable.

STATEMENT REGARDING FEDERALLY SPONSORED RESEARCH OR DEVELOPMENT

Not applicable.

NAMES OF PARTIES TO A JOINT RESEARCH AGREEMENT

Not applicable.

REFERENCE TO AN APPENDIX SUBMITTED ON COMPACT DISC

Not applicable.

BACKGROUND OF THE INVENTION

1. Field of the Invention

The present invention relates to post-tension anchor systems. More particularly, the present invention the relates to anchors used in such post-tension anchor systems. More particularly, the present invention the relates to devices that retain the sheathing of a tendon within an anchor. Additionally, the present invention relates to devices that seal an end of the anchor against the sheathing of the tendon.

2. Description of Related Art Including Information Disclosed Under 37 CFR 1.97 and 37 CFR 1.98

For many years, the design of concrete structures imitated the typical steel design of column, girder and beam. With technological advances in structural concrete, however, concrete design began to evolve. Concrete has the advantages of costing less than steel, of not requiring fireproofing, and of having plasticity, a quality that lends itself to free flowing or boldly massive architectural concepts. On the other hand, structural concrete, though quite capable of carrying almost any compressive load, is weak in carrying significant tensile loads. It becomes necessary, therefore, to add steel bars, called reinforcements, to concrete, thus allowing the concrete to carry the compressive forces and the steel to carry the tensile forces.

Structures of reinforced concrete may be constructed with load-bearing walls, but this method does not use the full potentialities of the concrete. The skeleton frame, in which the floors and roofs rest directly on exterior and interior reinforced-concrete columns, has proven to be most economical and popular. Reinforced-concrete framing is seemingly a simple form of construction. First, wood or steel forms are constructed in the sizes, positions, and shapes called for by engineering and design requirements. The steel reinforcing is then placed and held in position by wires at its intersections. Devices known as chairs and spacers are used to keep the reinforcing bars apart and raised off the form work. The size and number of the steel bars depends completely upon the imposed loads and the need to transfer these loads evenly throughout the building and down to the foundation. After the reinforcing is set in place, the concrete, comprising a mixture of water, cement, sand, and stone or aggregate and having proportions calculated to produce the required strength, is set, care being taken to prevent voids or honeycombs.

One of the simplest designs in concrete frames is the beam-and-slab. This system follows ordinary steel design that uses concrete beams that are cast integrally with the floor slabs. The beam-and-slab system is often used in apartment buildings and other structures where the beams are not visually objectionable and can be hidden. The reinforcement is simple and the forms for casting can be utilized over and over for the same shape. The system, therefore, produces an economically viable structure. With the development of flat-slab construction, exposed beams can be eliminated. In this system, reinforcing bars are projected at right angles and in two directions from every column supporting flat slabs spanning twelve or fifteen feet in both directions.

Reinforced concrete reaches its highest potentialities when it is used in pre-stressed or post-tensioned members. Spans as great as five hundred feet can be attained in members as deep as three feet for roof loads. The basic principle is simple. In pre-stressing, reinforcing tendons of high tensile-strength wires are stretched to a certain determined limit and then high-strength concrete is placed around them. When the concrete has set, it holds the steel in a tight grip, preventing slippage or sagging. Post-tensioning follows the same principle, but the reinforcing tendon, usually a steel cable, is held loosely in place while the concrete is placed around it. The reinforcing tendon is then stretched by hydraulic jacks and securely anchored into place. Pre-stressing is done with individual concrete members in the shop and post-tensioning as part of the structure on the site.

In a typical tendon tensioning anchor assembly used in such post-tensioning operations, there are provided anchors for anchoring the ends of the cables suspended therebetween. In the course of tensioning the cable in a concrete structure, a hydraulic jack or the like is releasably attached to one of the exposed ends of each cable for applying a predetermined amount of tension to the tendon, which extends through the anchor. When the desired amount of tension is applied to the cable, wedges or threaded nuts, or the like, are used to capture the cable at the anchor plate and, as the jack is removed from the tendon, to prevent its relaxation and hold it in its stressed condition.

In typical post-tension systems, the tendon is received between a pair of anchors. One of the anchors is known as the "live-end" anchor, and the opposite end is known as the "dead-end" anchor. The "live-end" anchor receives the end of the tendon which is to be tensioned. The "dead-end" anchor holds the tendon in place during the tensioning operation. Anchors known as "intermediate anchors" exist between the "live-end" and "dead-end" for concrete slabs having great lengths. To fix the tendon in any of these anchors, a plurality of wedges are inserted into an interior passageway of the anchor and around the exterior surface of the tendon. The tendon is then tensioned so as to draw the wedges inwardly into the interior passageway so as establish compressive and locking contact with an exterior surface of the tendon. The tendon in a dead-end anchor can be tightened in the factory and then shipped, along with the full length of tendon, for use at the job site.

One technique for forming such dead-end anchors is to insert the end of a tendon into the cavity of the anchor, inserting wedges into the space between the tendon and the wall of the cavity and then applying a tension force onto another end of the tendon so as to draw the wedges and the end of the tendon into the cavity in interference-fit relationship therewith. This procedure is somewhat difficult because the tendon can have a considerable length and because the use of tension forces can create a somewhat unreliable connection between the wedges and the tendon. Experimentation has found that the application of compressive force onto the end of the tendon creates a better interference-fit relationship between the wedges, the end of the tendon and the wall of the cavity of the anchor.

Another technique is described in U.S. Pat. No. 6,513,287, issued on Feb. 4, 2003 to the present inventor. This patent describes a method and apparatus for forming an anchorage of a post-tension system in which a tendon is positioned within a cavity of the anchor such that an end of the tendon extends outwardly of the cavity. A plurality of wedges are mechanically inserted within the cavity between the tendon and a wall of the cavity. Pressure is applied to an end of the tendon such that the tendon and the wedges are in interference-fit relationship within the cavity. A compression mechanism has a cylindrical member and a plunger extending in a channel of the cylindrical member. The wedges are attached to the cylindrical member and the cylindrical member is moved toward the cavity such that the wedges enter a space between the tendon and the wall of the cavity. The plunger applies a compressive force to the end of the tendon when the end of the tendon is in the channel of the cylindrical member.

One of the problems with conventional dead-end anchorages is that the sheathing over the tendon has a tendency to shrink over time. The shrinkage is the result of various factors. One major factor is that the sheathing is formed over the tendon in an extrusion process. As such, the polymeric material used for the sheathing is relatively hot as it exits the extrusion process. Immediately after leaving the extrusion process, the tendon, along with the sheathing, are tightly wound around a spool. During shipment, the tight winding of the tendon around the spool will mechanically resist any shrinking of the sheathing over the lubricated exterior of the steel cable on the interior of the sheathing. When the cable is unwound from the spool, these mechanical forces are released. As such, as the tendon is installed in an anchor, the relaxation of these mechanical forces will generally and slowly cause the sheathing to shrink over the length of the tendon. After the tendon is connected to a dead-end anchorage, the end of the sheathing will tend to shrink slowly away from the dead-end anchorage.

The problem that affects many anchorage systems is the inability to effectively prevent liquid intrusion into this area of the unsheathed portion where sheathing shrinkage has occurred. In normal practice, a liquid-tight tubular member is placed onto an end of the tendon so as to cover an unsheathed portion of the tendon. The tubular member slides onto and over the trumpet portion of the encapsulated anchor so as to be frictionally engaged with the trumpet portion of the anchor. The opposite end of the tubular member will include a seal that establishes a generally liquid-tight connection with the sheathed portion of the tendon.

In the past, various patents have issued to the present inventor relating to such corrosion-protection tubes. These patents were developed for the purpose of accommodating the natural shrinkage of the sheathing over the lubricated cable. For example, U.S. Pat. No. 5,839,235, issued on Nov. 20, 1998 to the present inventor, describes a corrosion protection tube for a post-tension anchor system. A tubular body is affixed in snap-fit engagement with the trumpet portion so as to extend outwardly from the trumpet portion in axial alignment therewith. The tubular body has a seal at an end opposite the trumpet portion so as to form a generally liquid-tight seal with an exterior surface of the tendon. The tubular body has a notch formed on an exterior surface thereof. The trumpet portion has an inwardly extending surface. The inwardly extending surface engages the notch so as to form a generally liquid-tight connection. A collar extends around the tubular body on a side of the notch so as to be in close relationship to the end of the trumpet portion.

U.S. Pat. No. 6,631,596, issued on Oct. 14, 2003 to the present inventor, teaches another corrosion protection tube for use on an anchor of a post-tension anchor system. This corrosion protection tube has a connection portion at one end and a sealing portion on an opposite end. The anchor has a trumpet portion with a notch extending therearound. The connection portion includes an inwardly extending surface for engagement with the notch of the trumpet portion. The sealing portion is in liquid-tight engagement with the sheathed portion of the tendon. Alternatively, the connection portion includes an additional inner sleeve so as to define an annular slot with the inwardly extending surface. The inner sleeve extends into the interior of the trumpet portion so that the inner sleeve and the trumpet portion are in a liquid-tight engagement.

U.S. Pat. No. 6,817,148, issued on Nov. 16, 2004 to the present inventor, describes another type of corrosion protection seal for the anchor of a post-tension anchor system. A seal member is affixed to an end of the tubular portion of the anchor opposite the anchor body. The seal member has a portion extending around the sheathed portion of the tendon in generally liquid-tight relationship therewith. The tubular portion has an interlock area extending therearound for engaging an interior surface of the seal member. The tubular portion has a length of generally greater than four inches extending outwardly of the anchor body.

U.S. Pat. No. 5,770,286, issued on Jun. 23, 1998 to the present inventor, shows a corrosion inhibitor retaining seal. This seal includes a cap having a tubular body and a surface extending across the of the tubular body. A corrosion-resistant material is contained within the interior area of the cap. This surface closes the end of the tubular body. A frangible area is formed on this surface The surface extends transverse to a longitudinal axis of the tubular body at one end of the tubular body. The frangible area has a thickness less than a thickness of a non-frangible remainder of the surface. The cap is formed of a polymeric material. The surface is formed of a deformable polymeric material such that the non-frangible portion of the surface forms a liquid-tight seal with an outer diameter of a tendon extending through the surface. The corrosion-resistant material is contained within the cap of a suitable volume so as to fill a void in the tubular member between the inner diameter of the tubular member and the outer diameter of a tendon extending therethrough.

U.S. Pat. No. 6,098,356, issued on Aug. 8, 2000 to the present inventor, shows a method and apparatus for sealing an intermediate anchorage of a post-tension system. This apparatus has a cap with an attachment section thereon. The attachment section is adapted to allow the cap to be connected to an end of the anchor body. The cap has a tubular member extending outwardly from the attachment section. The tubular member has an opening at an end opposite the attachment section. The cap also has a grease fitting formed thereon. The grease fitting is adapted so as to allow grease to be introduced into the interior passageway of the tubular member. The attachment section and the tubular member are integrally formed together of a polymeric material. A seal is affixed to the open end of the tubular member so as to form a liquid-tight seal over the sheathed portion of a tendon extending therethrough.

U.S. Pat. No. 6,381,912, issued on May 7, 2002 to the present inventor also shows a method of sealing the intermediate anchor of a post-tension system. An elastomeric seal has one end affixed to the anchor member and extending outwardly therefrom. A rigid ring member is detachably received within an opposite end of the seal. The ring member has an inner diameter greater than an outer diameter of the tendon. The opposite end of the seal is in liquid-tight compressive contact with the exterior surface of the tendon when the ring member is detached from the seal. The interior passageway of the anchor, the seal and the ring member have an inner diameter, when joined together, which is larger than the outer diameter of the tendon so as to allow the anchor member, the seal and the ring member to slide along the length of the tendon.

Over time, it was found that the use of corrosion-protection tubes could be avoided by using a sheathing lock on the end of an intermediate anchor. The sheathing lock generally holds the sheathing of a tendon adjacent the end of an anchor. Various patent applications, filed by the present inventor, address different sheathing locks: U.S. patent application Ser. No. 11/861,185, filed on Sep. 25, 2007, entitled "Apparatus for Preventing Shrinking of a Sheathing Over a Tendon"; U.S. patent application Ser. No. 11/933,029, filed on Oct. 31, 2007, entitled "Shrinkage Preventing Device for the Sheathing if a Tendon"; U.S. patent application Ser. No. 11/933,041, filed on Oct. 31, 2007, entitled "Shrinkage Preventing Apparatus for the Sheathing of a Tendon"; U.S. patent application Ser. No. 11/950,295, filed on Dec. 4, 2007, entitled "Unitary Sheathing Wedge"; U.S. patent application Ser. No. 12/100,066, filed on Apr. 9, 2007, entitled "Sheathing Lock"; U.S. patent application Ser. No. 12/123,432, filed on May 19, 2008, entitled "Sheathing Retaining Clip; and U.S. patent application Ser. No. 12/133,947, filed on Jun. 5, 2008, entitled "Compression Cap Sheathing Lock."

The use of the sheathing locks of the above-mentioned patent applications have given rise for the need for a seal on the end of anchor where the sheathing lock is placed. A typical sheathing lock holds the sheathing of a tendon within an anchor of a post-tension system. The sheathing lock is positioned either between a wall of the cavity of an anchor and the sheathing of tendon or a wall of the trumpet of the anchor and the sheathing of the tendon so as to retain the sheathing of the tendon from shrinkage. The sheathing lock can, and sometimes does, prevent the entry of moisture and other contaminants into the interior of the anchor. However, the sheathing lock sometimes is not a complete barrier to the entry of moisture and other contaminants into the anchor. Therefore, there is a need for an apparatus that seals the end of the anchor near the sheathing lock so as to prevent the entry of moisture and other contaminants into the space between the sheathing and the end of the anchor.

It is an object of the present invention to provide an apparatus that seals an end of an anchor near the sheathing lock.

It is another object of the present invention to provide an apparatus that retains the sheathing of a tendon with an anchor of a post-tension system.

It is another object of the present invention to provide an apparatus that seals the end of the anchor effectively and efficiently.

It is still another object of the present invention to provide an apparatus that is inexpensive.

It is another object of the present invention to provide an apparatus that is easy to install and easy to manufacture.

These and other objects and advantages of the present invention will become apparent from a reading of the attached specification and appended claims.

BRIEF SUMMARY OF THE INVENTION

The present invention is a post-tension apparatus comprising an anchor member having a cavity formed in an interior thereof, a tendon extending through the cavity of the anchor member the has an unsheathed portion and a sheathed portion, an encapsulation affixed to the anchor member and extending thereover that has a tubular extension formed at one end of the anchor member, a sheathing lock positioned in the cavity and engaged with the sheathed portion of the tendon, and a seal affixed within the tubular extension so as to reside in liquid-tight sealing relation with the sheathed portion of the tendon.

The seal is affixed to an interior wall of the tubular extension in liquid-tight sealing relation therewith. The seal has an end juxtaposed against the end of the anchor member. The seal has a first portion and a second portion. The second portion has an inner diameter less than an inner diameter of the first portion. The inner diameter of the first portion is greater than an outer diameter of the sheath lock. The trumpet has an inwardly extending shoulder abutting an end of the second portion. The seal is of a more pliable material than a material of the tubular extension.

The apparatus further comprises a pair of wedges recessed in the cavity of the anchor member. The pair of wedges is engaged with the unsheathed portion of the tendon. The sheathing lock is positioned adjacent an end of the pair of wedges. The cavity has a tapered portion and a generally constant diameter portion. The sheathed portion has an end received in the generally constant diameter portion. The pair of wedges is received in the tapered portion.

The sheathing lock is affixed within the generally constant diameter portion. The sheathing lock has a tubular body that has a plurality of ribs formed on an inner wall thereof. The plurality of ribs are engaged with the sheathed portion of the tendon. The sheathing lock also has a shoulder formed on an end thereof. The shoulder abuts an end of the sheathed portion.

DETAILED DESCRIPTION OF THE INVENTION

Figure 1:
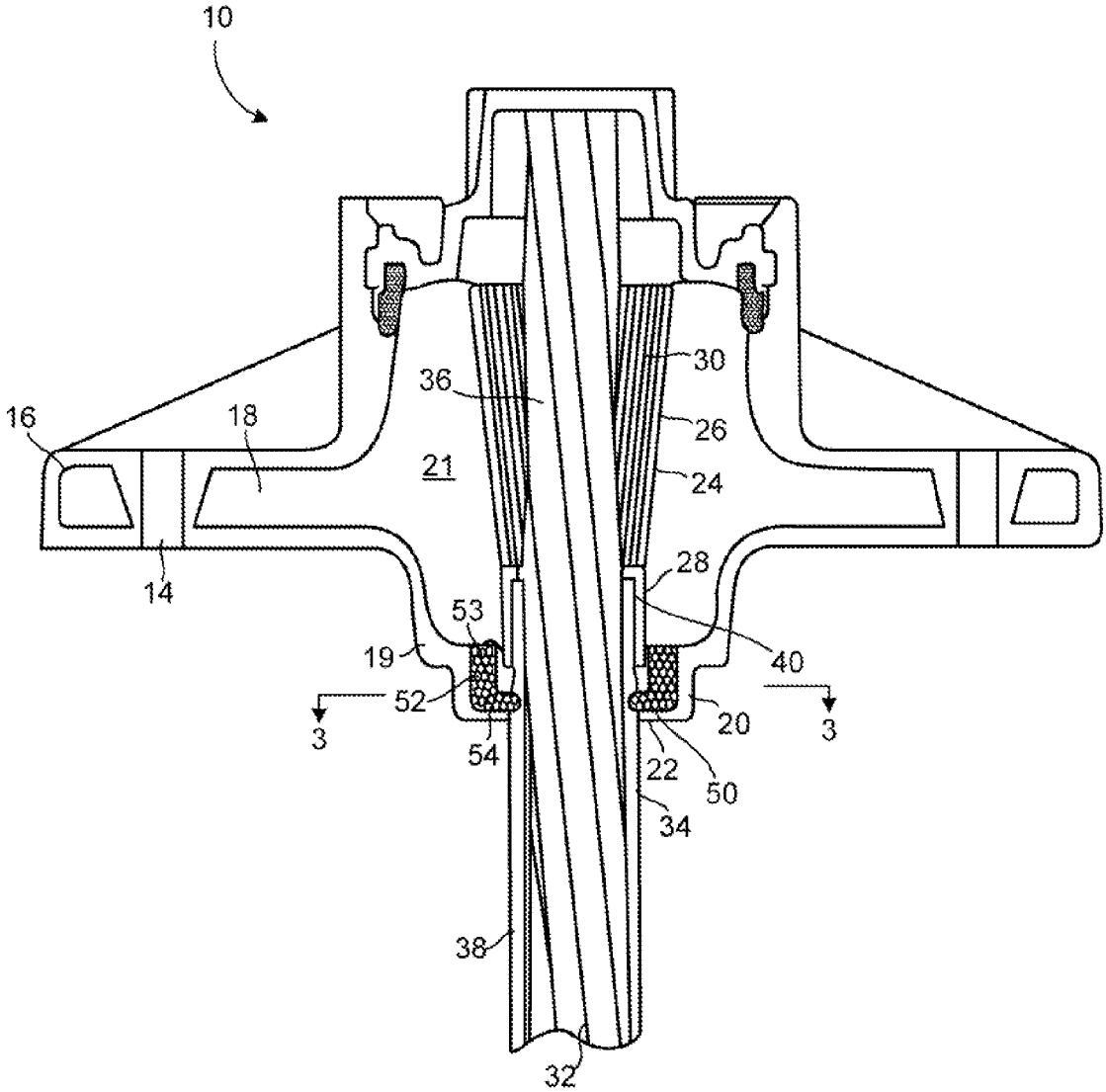
FIG. 1 shows a cross-sectional view of the preferred embodiment of the post-tension anchor system of the present invention.

Referring to FIG. 1, there is shown a cross-sectional view of the preferred embodiment of the post-tension system 10 of the present invention. The system 10 has a tendon 32 extending through an anchor 14. The tendon 32 has a sheathing 38. The sheathing 38 extends only over part of the tendon 32. Thus, the tendon 32 has a sheathed portion 34 and an unsheathed portion 36. The anchor 14 has a polymeric encapsulation 16 covering an anchor member 18. The polymeric encapsulation 16 has a tubular extension 20 extending outwardly from an end 19 of the anchor member 18. The anchor member 18 is connected to the unsheathed portion 36 of the tendon 32 by wedges 30. The tubular extension 20 extends around the sheathed portion 34 of the tendon 32. The tubular extension 20 has an opening 22 formed at an end thereof opposite the anchor member 18.

A cavity 24 is formed in the interior 21 of the anchor member 18 of the anchor 14. The cavity 24 has a tapered portion 26 and a generally constant diameter portion 28. The wedges 30 are affixed to unsheathed portion 36 of the tendon 32 within the tapered portion 26 of the cavity 24. The sheathing locking means is a sheathing lock 40 positioned in the cavity 24 of the anchor member 18 of the anchor 14. More particularly, the sheathing lock 40 is positioned in the generally constant diameter portion 28 of the cavity 24. The sheathing 38 of the tendon 32 is retained in the generally constant diameter portion 28 of the cavity 24 because the sheathing lock 40 is positioned between the sheathing 38 of the tendon 32 and the generally constant diameter portion 28 of the cavity 24. Because of the position of the sheathing lock 40 it is also positioned within the polymeric encapsulation 16 of the anchor 14. Furthermore, the sheathing lock 40 is positioned within the polymeric encapsulation 16 of the anchor 14.

A seal 50 is positioned adjacent the end 19 of the anchor member 18 of the anchor 14. The seal 50 is substantially tubular. The seal 50 is positioned adjacent an end 42 of the sheathing lock 40. The seal 50 is positioned along an inner wall 23 of the trumpet 20 of the polymeric encapsulation 16 of the anchor 14. The seal 50 can be made of a polymeric or an elastomeric material. The seal 50 has a first portion 52 and a second portion 54. The first portion 52 has an end 53 positioned adjacent the end 42 of the sheathing lock 40. The second portion 54 extends radially inwardly from the tubular extension 20. The inner diameter of seal 50 is greater than an outer diameter of the sheathing lock 40. One end of seal 50 abuts an end of the anchor member 18 so as to form a liquid-tight seal therewith. The seal 50 is affixed in liquid-tight sealing relation with an inner wall of the tubular extension 20. The annular second portion 54 has an inner diameter residing in liquid-tight sealing relation with the sheathing 38 of tendon 32. The seal 50 is of a more pliable material than the material of encapsulation 16 and of the tubular extension 20. As such, a continuous liquid-tight seal is formed between the anchor member 18 and the inner wall 23 of tubular extension 20 and the outer diameter of sheathing 38. The sheathing lock 40 allows a tubular extension 20 to be formed of a minimal length. Extension tubes, tape, and other seals are avoided. This serves to reduce the costs of production and labor required for assembly.

Figure 2:
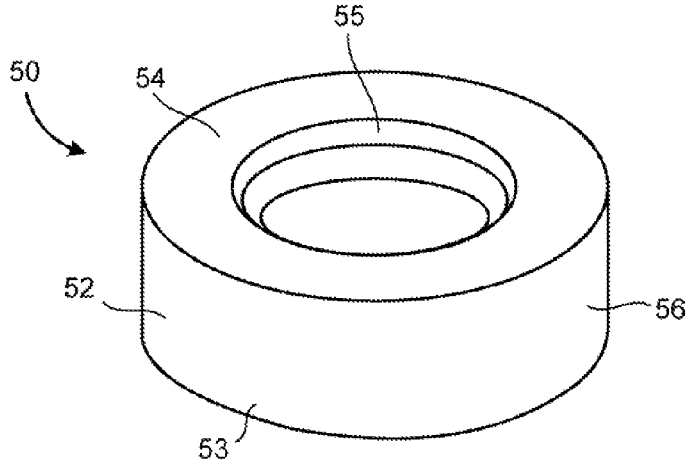
FIG. 2 shows an isolated perspective view of the preferred embodiment of the seal of the present invention.

Referring to FIG. 2, there is shown an isolated perspective view of the preferred embodiment of the seal 50 of the present invention. The seal 50 has a first portion 52 and a second portion 54. The second portion 54 extends radially inwardly from the outer surface 56 of the first portion 52. An inner surface 55 of the second portion 54 has a diameter smaller than a diameter of the first portion 52. The seal 50 is substantially tubular in shape. The seal can be formed of a polymeric or an elastomeric material. The inner surface 55 of the second portion 54 of the seal 50 sealingly engages the sheathing 38 of the tendon 32.

Figure 3:
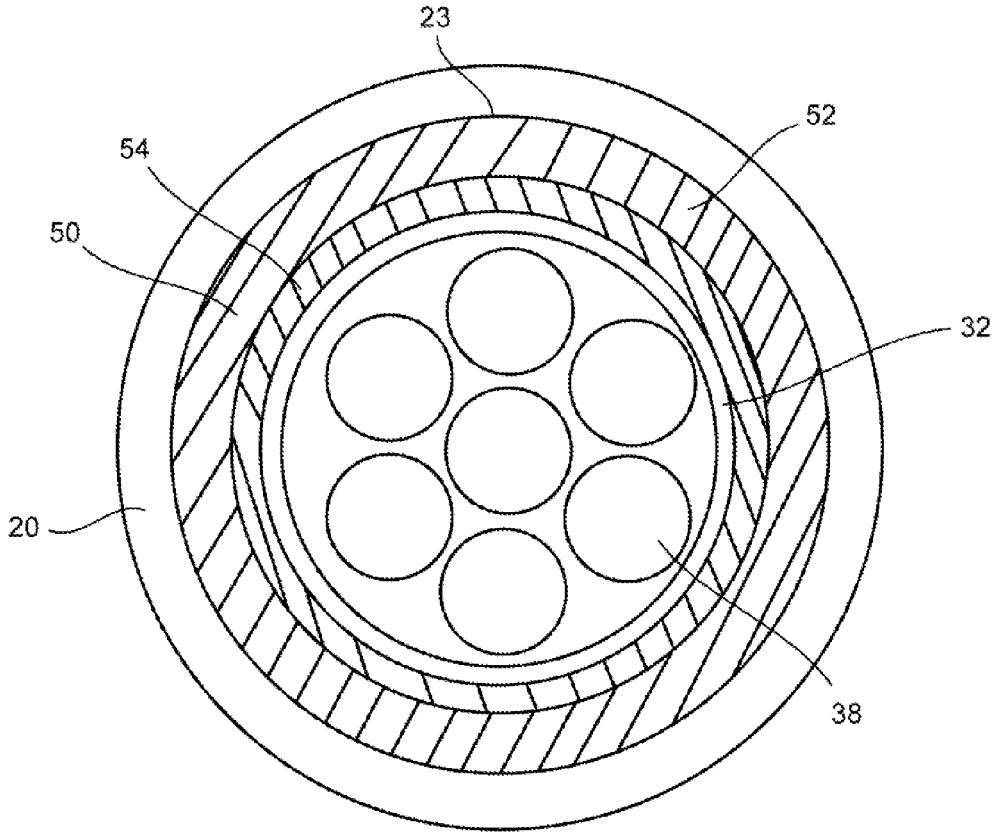
FIG. 3 shows a cross-sectional view of the seal as retained in the trumpet, taken along sight line 3-3 of FIG. 1.

Referring to FIG. 3, there is shown a cross-sectional view of the seal 50 as retained in the tubular extension 20, taken along sight line 3-3 of FIG. 1. The seal 50 can be seen as positioned along the inner wall 23 of the tubular extension 20. The second portion 54 of the seal 50 extends radially inwardly further than the first portion 52. The second portion 54 abuts the sheathing 32 of the tendon 38 so as to form a liquid-tight seal between the second portion 54 and the sheathing 32. The seal 50 is concentric with the tubular extension 20. The second portion 54 of the seal 50 is concentric with the first portion 52 of the seal 50. The sheathing 32 is concentric with the seal 50. The tendon 38 is concentric with the sheathing 32.

Figure 4:
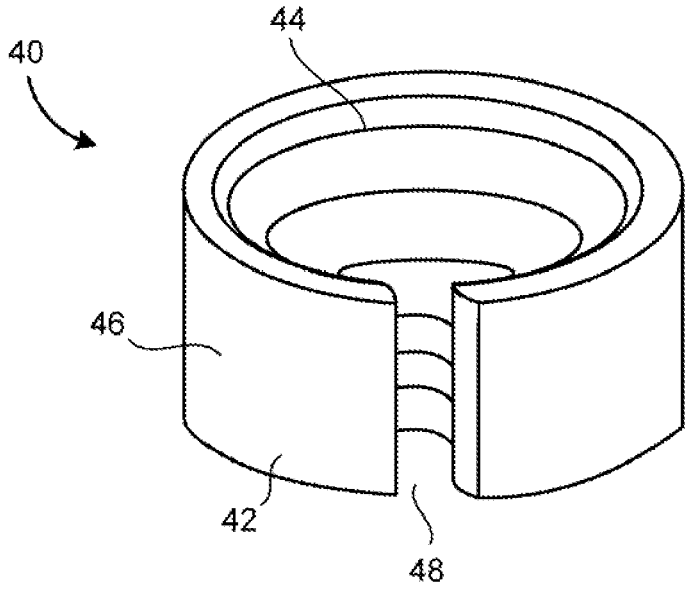
FIG. 4 shows an isolated perspective view of the preferred embodiment of the sheathing lock of the present invention.

Referring to FIG. 4, there is shown an isolated perspective view of the preferred embodiment of the sheathing lock 40 of the present invention. The sheathing lock 40 is substantially tubular in shape. The body 46 of the sheathing lock 40 has a split 48 so that the sheathing lock 40 can be placed around the sheathing 38 of the tendon 32. The split 48 closes as the sheathing lock 40 is inserted between the generally constant diameter portion 28 of the cavity 24 of the anchor 14 and the sheathing 38 of the tendon 32. Locking ribs 44 extend radially inwardly from the body 46 of the sheathing lock 40. The locking ribs 44 engage the sheathing 38 of the tendon 32. Various embodiments of the sheathing lock 40 entirely possible. For example, the sheathing lock 40 can have fins extending radially outwardly from the body 46 of the sheathing lock 40. Alternatively, the sheathing lock 40 could be two arch-shaped pieces that together form a tubular body around the sheathing 38 of the tendon 32. Thus, the present invention contemplates that the sheathing lock 40 can be made of any embodiment suitable for retaining the sheathing 38 of the sheathed portion 34 of the tendon 32 within the anchor 14.

When the sheathing lock 40 and seal 50 are together placed in the end 19 of the anchor 14, they create a seal for preventing the entrance of moisture and other contaminants into the end 19 of the anchor 14. This function is especially important because the unsheathed portion 36 of the tendon 32 resides within the anchor 14. Thus, the seal 50 and the sheathing lock 40 preform an important function of keeping moisture and other contaminants from degrading the quality of the unsheathed portion 36 of the tendon 32 located within the anchor 14, and thus preserving the integrity and strength of the post-tension system 10.

The foregoing disclosure and description of the invention is illustrative and explanatory thereof. Various changes in the details of the illustrated construction can be made within the scope of the appended claims without departing from the true spirit of the invention. The present invention should limited only by the following claims and their legal equivalents.

I claim:

1. A post-tension anchorage comprising:

an anchor member having a tapered cavity formed in an interior thereof, said cavity having a wall;

a polymeric encapsulation surrounding said anchor member, said encapsulation having a tubular extension integrally formed therewith, said tubular extension extending outwardly relative to said anchor member;

a sheathing locking means affixed against said wall of said cavity, said sheathing locking means for fixing a position of a sheathing of a tendon extending through said cavity; and a seal affixed against an interior wall of said tubular extension, said seal extending inwardly therefrom, said seal positioned adjacent an end of said sheathing locking means, said seal being juxtaposed against an end of said anchor member.

2. The post-tension anchorage of claim 1, said seal having an inner wall of a diameter greater than an outer diameter of said sheathing locking means.

3. The post-tension anchorage of claim 1, further comprising:

a tendon having a sheathed portion and an unsheathed portion; and a sheathing lock interposed between a wall of said cavity and said sheathed portion of said tendon, said seal being in liquid-tight sealing relation with said sheathed portion of said tendon.

4. The post-tension anchorage of claim 1, said seal having a first portion and a second portion, said second portion having an inner diameter less than an inner diameter of said first portion.

5. The post-tension anchorage of claim 1, said seal being of a more pliable material than a material of said tubular extension.

6. The post-tension anchorage of claim 1, said sheathing locking means comprising:

a tubular body having a plurality of locking ribs extending radially inwardly therefrom.

7. A post-tension apparatus comprising:

an anchor member having a cavity formed in an interior thereof;

a tendon extending through said cavity of said anchor member, said tendon having an unsheathed portion and a sheathed portion;

an encapsulation affixed to said anchor member and extending thereover, said encapsulation having a tubular extension integrally formed therewith, said tubular extension extending outwardly relative to an end of said anchor member;

a sheathing lock positioned in said cavity and engaged with said sheathed portion of said tendon; and a seal affixed within said tubular extension so as to reside in liquid-tight sealing relation with said sheathed portion of said tendon, said seal affixed to an interior wall of said tubular extension in liquid-tight sealing relation therewith, said seal having an end juxtaposed against said end of said anchor member, said seal having a first portion and a second portion, said second portion having an inner diameter less than an inner diameter of said first portion, said inner diameter of said first portion being greater than an outer diameter of said sheathing lock.

8. The post-tension apparatus of claim 7, said trumpet having an inwardly extending shoulder abutting an end of said second portion.

9. The post-tension apparatus of claim 7, said seal being of a more pliable material than a material of said tubular extension.

10. The post-tension apparatus of claim 7, further comprising:

a pair of wedges recessed in said cavity of said anchor member, said pair of wedges being engaged with said unsheathed portion of said tendon, said sheathing lock positioned adjacent an end of said pair of wedges.

11. The post-tension apparatus of claim 10, said cavity having a tapered portion and a generally constant diameter portion, said sheathed portion having an end received in said generally constant diameter portion, said pair of wedges being received in said tapered portion.

12. The post-tension apparatus of claim 11, said sheathing lock affixed within said generally constant diameter portion.

13. The post-tension apparatus of claim 7, said sheathing lock comprising:

a tubular body having a plurality of ribs formed on an inner wall thereof, said plurality of ribs being engaged with said sheathed portion of said tendon.

14. The post-tension apparatus of claim 13, said sheathing lock further comprising:

a shoulder formed on an end thereof, said shoulder abutting an end of said sheathed portion.

* * * * *